United States Patent [19]

Jackson

[11] Patent Number: 4,845,860

[45] Date of Patent: Jul. 11, 1989

[54] FOUNTAIN CONDITIONER FOR FIBROUS MATERIAL

[76] Inventor: Samuel G. Jackson, P.O. Box 16587, Lubbock, Tex. 79490

[21] Appl. No.: 152,412

[22] Filed: Feb. 4, 1988

[51] Int. Cl.[4] ..... F26B 17/00

[52] U.S. Cl. ..... 34/227; 34/231; 34/57 R

[58] Field of Search ..... 34/168, 169, 218, 219, 34/227, 229, 231, 236, 10, 57 R

[56] References Cited

U.S. PATENT DOCUMENTS

| | | | |
|---|---|---|---|
| 790,162 | 5/1905 | Trump | 34/57 R |
| 1,778,318 | 10/1930 | Haas | 34/168 |
| 1,871,773 | 8/1932 | Bennett | 34/168 |
| 2,820,306 | 1/1958 | Smith | 34/168 |

*Primary Examiner*—Henry A. Bennet

*Attorney, Agent, or Firm*—Robert A. Felsman; Charles D. Gunter, Jr.

[57] ABSTRACT

An improved method and apparatus for treating fibrous material are shown. A concurrent stream of air and fibrous material are spewed into an empty chamber large enough to allow the fibrous material to fall out of the conveying air into a collecting duct where the two components are removed in a concurrent stream having the normal conveying velocity. An evasé section at the entrance of the chamber promotes the slowing of the seed cotton, allowing it to come to a state of agitation with respect to the air in the chamber before being drawn out the chamber exit where it is again accelerated with the outgoing stream of air.

7 Claims, 3 Drawing Sheets

FOUNTAIN CONDITIONER FOR FIBROUS MATERIAL

FIELD OF THE INVENTION:

This invention deals with the art of drying fibrous material in a concurrent stream of hot air or of raising the moisture content of fibrous material in a concurrrent stream of warm humid air. It teaches a method of promoting slippage of the stream of air past the fibrous material so as to enhance the interchange of moisture between the two. The method utilized is that of spewing the concurrent stream upward in an empty chamber large enough to allow the fibrous material to fall out of the conveying air then removing the two components together at the bottom of the chamber in a concurrent stream having the normal conveying velocity. The method and device have particular application in drying and humidifying seed cotton.

DESCRIPTION OF THE PRIOR ART:

While the present invention is applicable to the drying and humidifying of many different fibrous materials, the prior art described will relate mainly to the art of drying seed cotton. Where drying processes are described, it will be understood that they are usually applicable to humidification without modification.

When drying seed cotton, it is customary to expose it to hot air, which absorbs the moisture and carries it away from the cotton fibers. The removal of moisture from cotton fibers is an endothermic process. Sensible heat in the air is given up in the process. This lowers the dry bulb temperature of the air, while the absorption of moisture from the cotton raises the wet bulb temperature of the air.

Seed cotton dryers can be broadly classified as counterflow, crossflow, and concurrent or parallel flow dryers. In the counterflow dryer, the path taken by the drying air is opposite to that of the seed cotton. The incoming air first contacts the outgoing seed cotton, and the incoming seed cotton first contacts the outgoing drying air. This is desirable, but when attempting to use a large volume of drying air, it tends to carry the fluffy seed cotton in a concurrent path instead of the desired counterflow arrangement. In order to overcome this, various mechanical means have been used or proposed. An example of this type dryer is the Smith U.S. Pat. No. 2,820,306.

An example of the crossflow dryer is seen in the Haas U.S. Pat. No. 1,778,318. This form of dryer is seldom used for seed cotton because of its large physical size. It has the advantage of utilizing a high ratio of air to seed cotton with little horsepower required.

The most widely used dryer for seed cotton is the concurrent type, specifically the design shown in the Bennett U.S. Pat. No. 1,871,773. This design has the advantage of being simple to construct and having no moving mechanical parts. It has the disadvantage of using a large amount of horsepower due to the pressure drop of the air moving through the shelves, approximately ½-inch static pressure loss per shelf of dryer. A more serious deficiency of the tower dryer has been brought out by a recent investigation which indicates that it makes no constructive contribution to drying the seed cotton.

In recent years, several drying systems have been modified by simply removing the tower dryers and using the existing air heaters and fans to move the cotton with less horsepower and with equal drying effect. In some cases the fans which push the air through the heaters have been removed, leaving only the pull fans, this being possible because of the lower pressure loss through the system.

In drying systems using tower dryers, as well as in the towerless systems in which the tower dryers have been removed, it has been found that the majority of the drying of the fiber on the seed cotton occurs at the instant the cotton is dropped into the stream of hot air which conveys it through the drying system. This is explained by the fact that in accelerating the seed cotton up to the air velocity, there is significant slippage of the air through the cotton, allowing an interchange of moisture. There then seems to be no loss of moisture from the cotton to the air during its passage through connecting pipes or through the tower dryer, if it is present. An additional significant amount of drying, though less than at the mix point, occurs in the inclined cleaner which is usually used to separate the seed cotton from the drying air. This, too, is explained by slippage of the air through the seed cotton.

In the tower systems, a large quantity of heat is lost from uninsulated tower dryers. In the towerless systems, which do not have so much heat loss, there is still a great deal of drying capability left in the air which is discharged from the inclined cleaners. It is desirable to utilize this heat.

SUMMARY OF THE INVENTION

The device of the invention results in an improvement over the tower dryer type system by promoting additional slippage of the drying air through the cotton without interposing a large pressure drop. It thereby utilizes more of the drying capacity of the air and makes the system more efficient. Even more importantly, the increased drying effect which is achieved insures that seed cotton will be adequately dried by the time it reaches the first inclined cleaner. This is of far greater economic significance than the cost of the fuel consumed, as it means that the cotton is cleaned more efficiently, achieving a higher grade. It also means that less cotton is wasted by the cleaners, achieving a higher lint turnout.

In the present invention, I give the cotton a second accleration in the same drying air to provide the desired increase in drying effectiveness. Specifically, I have devised a closed chamber into which the cotton and hot air are blown upwardly at one side of the chamber. The velocity of the upward stream is adjustable and is lower than that normally used for the pneumatic conveying of seed cotton. An evasé section at the entrance promotes the slowing of the seed cotton, allowing it to come to a state of stagnation with respect to the air in the chamber so that it floats lazily downward to the exit at the bottom of the chamber where it is again accelerated with the outgoing stream of air, thus producing the desired increase in drying effect. The typical loss of static pressure across such a dryer is approximately 0.3 inches of water.

The principal object of this invention is to provide an apparatus which increases the interchange of moisture between fibrous material and conditioning air in a concurrent flow system.

Another object is to improve such interchange with only a negligible pressure drop.

Another object is to provide these benefits with a device which has no moving parts.

Additional objects, features and advantages will be apparent in the written description which follows.

DESCRIPTION OF THE PREFERRED EMBODIMENT

Figure 1:
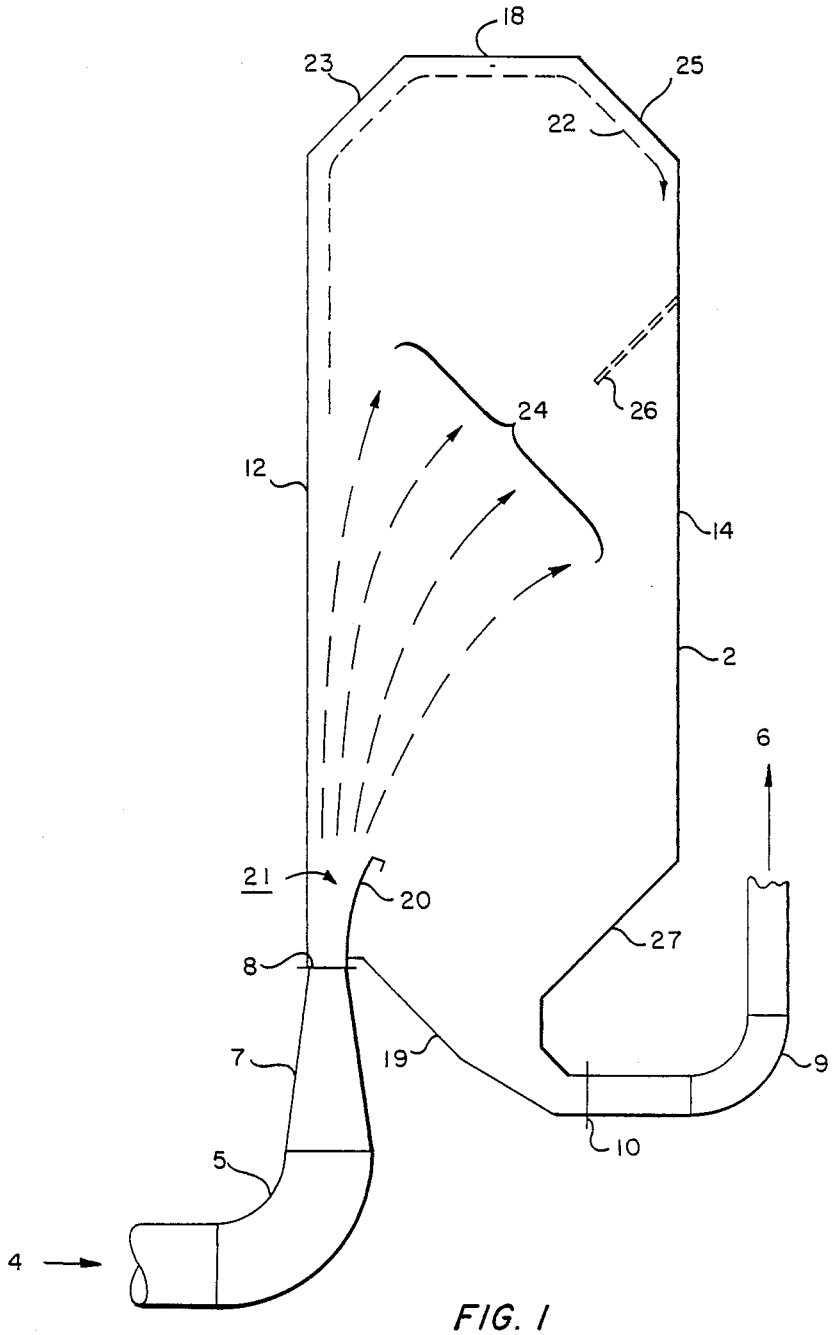
FIG. 1 is a schematic sectional view illustrating the operation of the fountain conditioner of the invention.

We will refer first to FIG. 1, which is a schematic view of the fountain conditioner. It is a sealed chamber 2 into which the incoming stream 4 of seed cotton and hot air is introduced through entrance opening 8.

The chamber 2 is a generally rectangular metal box having a vertical wall 12 adjacent the entrance 8, a vertical wall 14 opposite wall 12 and two adjoining walls 16. It also has a top 18 which is formed of three surfaces, a horizontal, planar section 18 and vertically sloping sections 23, 25 which join the section 18 to the sidewalls 12,14. As will be described, this arrangement facilitates the flow of air from wall 12 to wall 14. The bottom of the chamber 2 is formed by convergent bottom pieces 19, 27 which funnel the air and fibrous material into exit opening 10. While the physical dimensions of the chamber 2 do not appear to be critical, we have obtained good results by spacing walls 12 and 14 seventy-eight inches apart and the other two walls 16 fifty-four inches apart. An overall height for the chamber 2 of about 19 feet has worked well.

Figure 2:
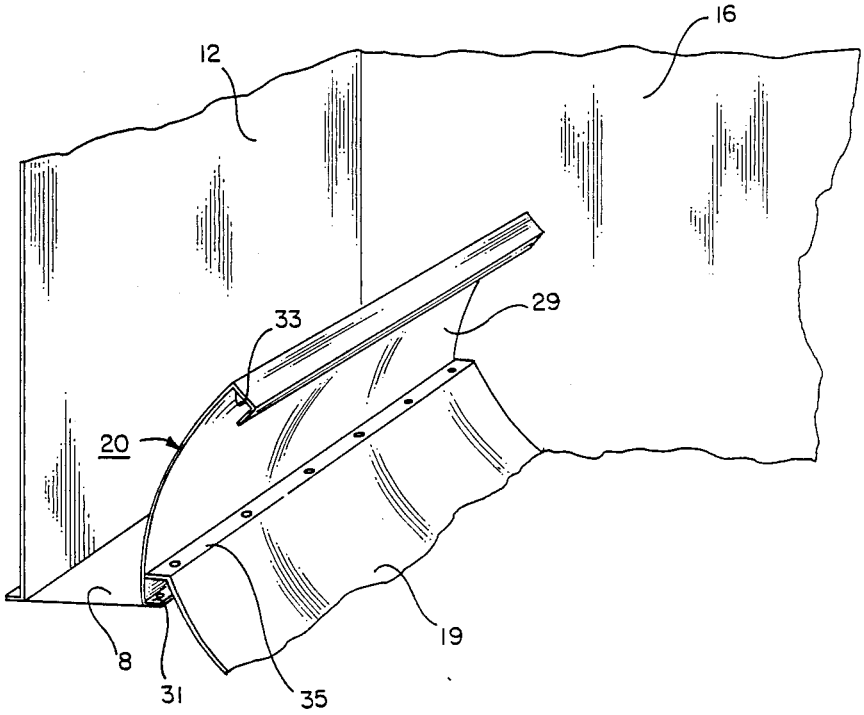
FIG. 2 is a view of the interior of the fountain conditioner, with portions broken away, showing the adjustable passageway of the device.
Figure 3:
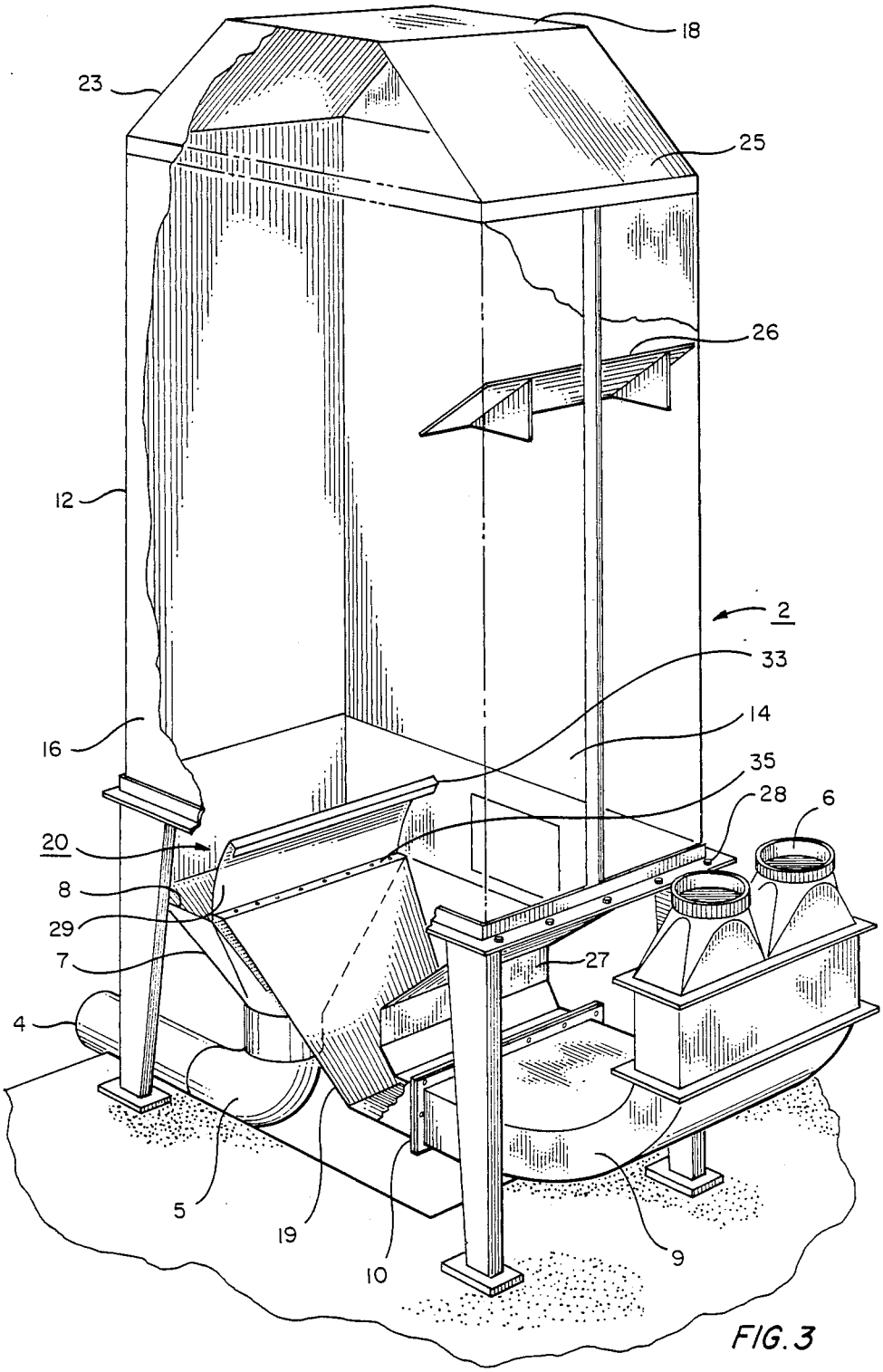
FIG. 3 is a perspective view of the fountain conditioner with portions broken away for ease of illustration.

We will follow the path of cotton and air flow in order to explain the operation of this dryer. Although push and pull fans of the type known in the art may be used to move the air through the system, only a pull fan will usually be used because of the low pressure drop through the fountain dryer. First, hot air is pulled from a conventional air heater, which is usually an oil or gas fired burner burning directly in the incoming air stream 4. The damp seed cotton is also dropped into this hot air stream by a feed control unit (not shown). During the short time it takes to accelarate the locks of seed cotton up to the air velocity, a considerable amount of drying takes place. This stream of cotton and air 4 is conveyed through pipe 5 to the fountain dryer. The velocity in pipe 5 will normally be about 4,000 fpm. A transition piece 7 having a round bottom end and a rectangular top end connects the round pipe 5 to a rectangular entrance opening 8, where the velocity should be about 3,000 fpm. A vertically extending, adjustable passageway or nozzle piece 20 inside the fountain dryer flares outward from adjacent wall 12 to form an evasé passage 21 which increases in cross-sectional area in an upward direction. The gradual increase of cross-sectional area in passage 21 serves to slow down the velocity of the stream of cotton and air. As best seen in FIGS. 2 and 3, the nozzle piece 20 is actually a metal flap including a planar sidewall portion 29 joined to the chamber bottom by a perpendicular edge 35 at one extent and having an outwardly extending U-shaped channel 33 at the opposite extent. The convergent bottom piece 19 has a horizontal planar section to which the perpendicular edge 35 of nozzle piece 20 is bolted. By bending the flap 29, the size of the passage 21 can be adjusted. In this way, the deflecting capability of piece 20 is adjustable so as to obtain the desired velocity at the exit of passage 21. A greater deflection forms a larger discharge area and slower velocity. We have found a discharge velocity of about 2,500 fpm to be desirable.

If piece 20 is adjustable so passage 21 is straight or convergent, the stream will follow path 22 up adjacent side 12, down opposite side 14 and out exit 10. We have observed that this mode of operation is not effectual in drying. When the stream is slowed, by making the passage 21 increases in cross-sectional area in the upward direction, the cotton and air will follow the paths 24. The locks of cotton then float lazily downward until they are funnelled into exit opening 10 and accelerated to the conveying velocity of about 4,000 fpm. This latter mode of operation dries much more effectively. The dryer is usually located so that a flat duct 9 will be used to take the outgoing stream 6 of cotton and air to the conventional inclined cleaner.

In the normal mode of operation, we can still observe a small amount of cotton and air following path 22. This is the lightest and driest portion of the cotton. Because of this, the fountain dryer is selective in its drying effect, drying the wetter portions more. Although this selective treatment is desirable in the drying process, it is not desirable where we humidify seed cotton with humid air. For this purpose we add a rectangular-shaped deflector plate 26 to divert the dry cotton in path 22 away from wall 14 to make it mix with the cotton in paths 24.

The convergent bottom pieces 19 are connected to the chamber sidewalls 12,14,16 by means of a bolted joint 28. The portion below this joint is easily changed to increase or decrease the size of entrance opening 8 and exit opening 10. This is necessary to adapt the dryer to different air flow volumes required.

An invention has been provided with several advantages. The apparatus of the invention provides increased interchange of moisture between fibrous material and conditioning air in a concurrent flow system. The apparatus of the invention achieves this purpose with only a negligible pressure drop in the air pressure of the air in the concurrent flow stream. The device is simple in design and economical to manufacture due to the absence of moving parts.

While the invention has been shown in only one of its forms, it is not thus limited, but is susceptible to various changes and modifications without departing from the spirit thereof.

I claim:

1. An apparatus for increasing the interchange of moisture between seed cotton and conditioning air in a concurrent air flow system, the apparatus comprising;

an enclosed chamber having a top, a bottom and connecting vertical sidewalls which define a generally rectangular interior, the chamber also having an entrance opening and an exit opening both of which are located in the chamber bottom;

means for introducing a stream of conditioning air and cotton to the entrance opening in the bottom and for concurrently conveying the cotton from the exit opening in an airstream at a normal conveying velocity; and a vertically extending, adjustable flap at the chamber entrance opening which flares outwardly from the chamber sidewalls to form an evase passage of gradually increasing cross-sectional area for lowering the velocity of the cotton in the entering stream, whereby the cotton is blown upwardly and is allowed to float downwardly within the chamber before again being accelerated to normal conveying velocity within the chamber exit opening.

2. An apparatus for increasing the interchange of moisture between seed cotton and conditioning air in a concurrent air flow system, the apparatus comprising:

an enclosed chamber having a top, a bottom and connecting vertical sidewalls which define a generally rectangular interior, the chamber also having an entrance opening and an exit opening both of which are located in the chamber bottom;

means for introducing a moving stream of conditioning air and cotton through the entrance opening in the bottom of the chamber and for concurrently conveying cotton from the exit opening in an airstream at a normal conveying velocity; and wherein a vertically extending, bendable flap is located at the entrance opening in the bottom of the chamber, and wherein the bendable flap flares outwardly from the chamber sidewalls to form an evase passage of gradually increasing cross-sectional area, the passage being effective to reduce the velocity of the cotton entering the entrance opening and being discharged into the closed chamber, whereby the cotton floats downwardly within the chamber before again being accelerated to normal conveying velocity within the chamber exit opening.

3. An apparatus used for drying seed cotton being moved in a concurrent stream of hot air through a pneumatic conveying system, the apparatus comprising:

an enclosed chamber having a top, bottom and connecting sidewalls, the chamber also having an entrance opening and an exit opening in the bottom thereof;

a feed conduit for introducing a stream of cotton and concurrently moving hot air, moving at a normal conveying velocity, to the entrance opening of the chamber;

a pull fan connected to the exit opening to the chamber for concurrently conveying cotton out the chamber exit opening;

wherein the chamber entrance opening includes a vertically extending adjustable passgeway which flares outwardly from the chamber sidewalls to form an evase passage of gradually increasing cross-sectional area, the increasing cross-sectional area of the passage being effective to reduce the velocity of the cotton being discharged through the passage into the closed chamber from a normal conveying velocity of the feed conduit to a lesser relative velocity, whereby the cotton floats downwardly within the chamber toward the chamber exit opening in fountain-like fashion before being returned to normal conveying velocity upon entering the chamber exit opening; and wherein the adjustable passageway comprises a flap including a planar sidewall portion joined to the chamber bottom at one extent and having a free, opposite extent, the cross-sectional area of the passageway being adjustable by bending the flap planar sidewall portion toward or away from the adjacent chamber sidewall.

4. An apparatus used for drying seed cotton being moved in a concurrent stream of hot air through a pneumatic conveying system, the apparatus comprising:

an enclosed chamber having a top, a bottom and connecting sidewalls, the chamber also having an entrance opening and an exit opening in the bottom thereof;

a feed conduit for introducing a stream of cotton and concurrently moving hot air, moving at a normal conveying velocity, to the entrance opening of the chamber;

a pull fan connected to the exit opening of the chamber for concurrently conveying cotton out the chamber exit opening;

wherein the chamber entrance opening includes a vertically extending adjustable passageway which flares outwardly from the chamber sidewalls to form an evase passage of gradually increasing cross-sectional area, the increasing cross-sectional area of the passage being effective to reduce the velocity of the cotton being discharged through the passage into the closed chamber from a normal conveying velocity of the feed conduit to a lesser relative velocity, whereby the cotton floats downwardly within the chamber toward the chamber exit opening in foutain-like fashion before being returned to normal conveying velocity upon entering the chamber exit opening, the velocity of the cotton in the feed conduit being approximately 4,000 fpm, the discharge velocity of cotton through the adjustable passageway being approximately 2,500 fpm; and wherein the adjustable passageway comprises a flap including a planar sidewall portion and a perpendicular portion joined to the chamber bottom at one extent and having a free, opposite extent, the cross-sectional area of the passageway being adjustable by bending the flap planar sidewall portion toward or away from the adjacent chamber sidewall.

5. The apparatus of claim 4, wherein the chamber bottom is made up of converging bottom pieces, at least one of the bottom pieces having a horizontal portion which contacts the flap perpendicular portion.

6. The apparatus of claim 5, wherein the chamber top includes a horizontal, planar section which is connected to the chamber sidewalls by a pair of vertically sloping sections to facilitate the flow of hot air and cotton through the chamber.

7. The apparatus of claim 6, wherein the entrance opening of the chamber is located in the chamber bottom adjacent a chamber sidewall and wherein a deflector plate is mounted within the chamber on an opposite sidewall thereof for diverting cotton which is discharged from the adjustable passageway away from the chamber sidewalls as the cotton travels toward the exit opening.

* * * * *